US005358841A

United States Patent [19]

Ohtani

[11] Patent Number: 5,358,841

[45] Date of Patent: Oct. 25, 1994

[54] METHOD FOR PREPARING A SILVER HALIDE EMULSION

[75] Inventor: Hirofumi Ohtani, Hino, Japan

[73] Assignee: Konica Corporation, Tokyo, Japan

[21] Appl. No.: 129,026

[22] Filed: Sep. 29, 1993

Related U.S. Application Data

[63] Continuation of Ser. No. 714,692, Jun. 13, 1991, abandoned.

[30] Foreign Application Priority Data

Jun. 19, 1990 [JP] Japan ..... 2-160954

[51] Int. Cl.[5] ..... G03C 1/035

[52] U.S. Cl. ..... 430/569; 430/567; 430/605; 430/611; 430/614; 430/615

[58] Field of Search ..... 430/569, 567, 611, 605, 430/614, 615

[56] References Cited

U.S. PATENT DOCUMENTS

| | | | |
|---|---|---|---|
| 3,482,982 | 12/1969 | Miyata | 430/569 |
| 4,459,353 | 7/1984 | Maskasky | 430/567 |
| 4,672,026 | 6/1987 | Daubendiek | 430/495 |
| 4,798,775 | 1/1989 | Yagi et al. | 430/569 |
| 4,945,037 | 7/1990 | Saitou | 430/567 |
| 5,009,991 | 4/1991 | Mowforth et al. | 430/567 |
| 5,017,469 | 7/1991 | Mowforth et al. | 430/569 |
| 5,262,294 | 11/1993 | Yagi et al. | 430/567 |

FOREIGN PATENT DOCUMENTS

| | | | |
|---|---|---|---|
| 0405938 | 1/1991 | European Pat. Off. | 430/569 |
| 0359507 | 3/1991 | European Pat. Off. . | |

*Primary Examiner*—Charles L. Bowers, Jr.
*Assistant Examiner*—John A. McPherson
*Attorney, Agent, or Firm*—John B. Bierman

[57] ABSTRACT

A method for preparing a silver halide emulsion is disclosed. The silver halide emulsion comprises silver halide grains which are mixed crystals comprising: preparing a seed emulsion comprising seed grains; and adding potentially effective silver iodide grains comprising a silver halide micro grains having γ-AgI structure, a soluble salt and a soluble halide to the seed emulsion.

8 Claims, No Drawings

METHOD FOR PREPARING A SILVER HALIDE EMULSION

This application is a continuation of application Ser. No. 07/714,692, filed Jun. 13, 1991, now abandoned.

BACKGROUND OF THE INVENTION

This invention relates to silver halide photographic materials, more particularly to high-sensitivity, low-fog silver halide photographic materials.

The essential requirements that have to be satisfied by silver halide photographic materials are that they have high sensitivity while suffering from low fog. The common practice for meeting this need is to control in various ways the conditions of growing silver halide grains to be contained in silver halide emulsions for use in silver halide photographic materials. The step involved in the growth of silver halide grains for modifying their size and crystallographic shape to thereby establish the grain size and distribution is generally referred to as "physical ripening".

Physical ripening is divided into two typical types on the basis of the driving force that causes grain growth. In the first type of physical ripening, silver halide (hereinafter abbreviated to AgX as appropriate) grains are grown on the basis of variations in dissolving pressure among fine grains. Stated more specifically, new irregular shaped micrograins of AgX are created in a suspension medium and, in accordance with variations in site dependent and/or time-dependent conditions of grain formation in the suspension medium during the creation of said new micrograins, the relative sizes of the micrograins will vary to cause differences in their tendency to agglomerate or the dissolving pressures of individual micrograins that are determined from their solubility products and sizes will vary, causing those grains to grow either by agglomeration or by survival of grains having lower dissolving pressures at the expense of those having higher pressures which will disappear eventually. As the surface activity of agglomeration is exhausted, grain growth by the difference in dissolving pressure will dominante. For the purpose of the present discussion, this process of grain growth may conveniently be called a "dissolving pressure dependent process". The growth process that is solely dependent on dissolving pressure is especially referred to as "Ostwald ripening". Taken individually, the AgX crystal grains produced by this process are subject to annealing and, as a result of the gradual decrease in dislocations and other crystal defects, a normal equilibrium will finally be reached. However, taken collectively (from an intergrain viewpoint), the grain size distribution will broaden unavoidably and it is difficult to guarantee uniformity in the compositional ratios of AgX contained in the grains and their crystallographic shape.

The second type of physical ripening is the process in which existing irregular shaped micrograins or crystal grains in a suspension medium are used as nuclei for crystal growth onto the surfaces of which new AgX is deposited or precipitated to cover and increase the size of the existing grains. This process may be referred to as a "crystal nucleation process", in which the growth of grains is inevitably accomplished by supplying new AgX in multiple stages. According to this crystal nucleation process, not only grains already having stable sizes but also the initially created primitive micrograins work as nuclei for the crystal growth of subsequently created AgX if pAg, the rate of creation or pH is properly adjusted, whereby a group of crystalline grains grown to a substantially uniform size can be obtained. Further, a crystal control agent may be additionally used during the period when new AgX is supplied in multiple stages and this is advantageous for imparting a desired crystallographic shape. If the suspension of primitive micrograins initially formed in the "crystal nucleation process" is designated as a primitive (zero-order) seed emulsion, subsequent suspensions can accordingly be defined as the first-order, second-order and third-order up to the nth-order seed emulsions in succession.

Needless to say, a method intermediate between the two typical processes may be adopted as required for producing emulsions.

If, in the above-described processes for the production of emulsions, any by-products of reaction or excess compounds or additives that will eventually dissolve in emulsions are anticipated to cause adverse effects on subsequent steps or characteristic designs, those deleterious materials are usually eliminated from the system. In modern emulsion making technology, the flocculation process which employs flocculants is commonly selected as a means of eliminating the deleterious materials.

While there are two typical processes available for physical ripening, the dissolving pressure dependent process has the disadvantage of producing a broad size distribution of AgX grains, inter-grain variations in the compositional ratios of incorporated AgX, and differences in the conditions of grain surfaces, so the emulsions prepared by this process are variable in light acceptance, quantum efficiency, the adsorbability of additives, and developing ability, with the result that the finished emulsions vary greatly in performance.

On the other hand, the crystal nucleation process is capable of producing emulsions comprised of a group of monodisperse grains that are uniform in grain size and compositional ratio between grains and that feature easy control of characteristics and hence consistent production of emulsions having desired characteristics. Therefore, this process is extensively used today to meet the increasingly stringent requirements of photographic performance.

However, the emulsions prepared by the conventional crystal nucleation process in which crystals are grown using a seed emulsion as in the prior art have the disadvantage that they do not necessarily satisfy the need of users for higher sensitivity and lower fog.

SUMMARY OF THE INVENTION

An object, therefore, of the present invention is to provide silver halide photographic materials that retain the advantages offered by the crystal nucleation process and which yet have higher sensitivity while suffering from lower fog.

This object of the present invention can be attained by a method for preparing a silver halide emulsion comprising silver halide grains which are mixed crystals comprising: preparing a seed emulsion comprising seed grains; and adding potentially effective silver iodide grains comprising a silver halide micro grains having $\gamma$-AgI structure, a soluble silver salt and a soluble halide to the seed emulsion. This emulsion is hereinafter sometimes referred to as the "emulsion of the present invention" as appropriate for the case.

DETAILED DESCRIPTION OF THE INVENTION

In the present invention, the silver halide grains incorporated in the emulsion form mixed crystals in the interior of the grains and/or between the grains in the following two manners; in one case, different silver halides are mixed in a single grain to form a mixed crystal, and in the other case, two or more different silver halide crystal grains are present to provide a system which, taken as a whole, contains a mixture of the different silver halides. The mixed crystals formed in the present invention may assume one of the following three structures; a structure in which a guest AgX forming a complete solid solution phase is distributed within silver halide (AgX) grains either throughout or partially with a uniform or continuous density gradient; a structure in which the guest AgX forming a solid solution or non-solid solution phase is interspersed discretely as lumps or shells within silver halide (AgX) grains with a discontinuous density gradient; and a structure in which AgX grains of different composition are present between grains.

The AgX grains obtained in the process of preparation of the emulsion to be used in the present invention are contained in at least one emulsion layer in the photographic material of the present invention. Preferably, those AgX grains are contained in an amount of at least 30 mol % as AgX in at least one such emulsion layer, with the inclusion of at least 60 mol % being more preferred. When the photographic material is of a multilayered structure, the emulsion in accordance with the present invention is preferably incorporated at least in the emulsion layer where the advantages of the present invention should be utilized the most. Further, it is particularly preferred that the emulsion in accordance with the present invention is incorporated in all of the emulsion layers in the photographic material.

In the next place, the means of preparing the emulsion in accordance with the present invention is described below.

Basically, it is preferred that the following starting materials are used in preparing the emulsion in accordance with the present invention: AgX fine grains having the least solubility product of the AgX components of a mixed crystal (said fine grains are hereinafter referred to as "potentially effective AgX grains"); a seed emulsion; and AgX creating elements (to be called "makeup AgX elements") that are supplied to form and condition mixed crystal grains, namely, solutions of a soluble silver salt (typically silver nitrate) and a soluble halide.

In the process of preparing the emulsion in accordance with the present invention, the grains of the seed emulsion are usually allowed to be present in an emulsion mother liquor (i.e., a medium in which the AgX grains of mixed crystal are formed and conditioned) prior to the addition of the makeup AgX elements. The potentially effective AgX grains need be allowed to be present in the emulsion mother liquor not later than the end of addition of the makeup AgX elements. Hence, part of the potentially effective AgX grains may be present in the mother liquor prior to the seed emulsion whereas the remaining part is added after the seed emulsion.

The mechanism of the action of potentially effective AgX has not yet been completely unravelled but it can at least be said that in adjustments of photographic characteristics, the potentially effective AgX would produce a "hidden flavor" as in cooking.

The composition of the potentially effective AgX will vary with the kind of emulsion to be prepared but when preparing a silver halide emulsion containing silver iodide, the total silver iodide content of the emulsion is preferably provided by potentially effective AgI grains even in the case of silver iodide mixed crystals having a significantly high silver iodide content in the final composition (the silver iodide is hereinafter sometimes designated AgI as appropriate). However, the quantity of AgI production may be partly provided by the makeup AgX to an extent that is not deleterious to the intended performance of the emulsion.

If the potentially effective AgI is allowed to be present in the emulsion mother liquor prior to the addition of the grains of seed emulsion, AgI may be created in the mother liquor using KI and $AgNO_3$. Needless to say, potentially effective AgI grains created in a separate step may be added to the mother liquor. The silver nitrate solution to be used in creating potentially effective AgI may be a solution of ammoniacal silver nitrate.

The silver halide emulsion to be used in the present invention is prepared in such a way that silver iodide micrograins having $\gamma$-AgI in the crystal phase are allowed to be present until the end of the supply of elements for the creation of mixed crystal forming silver halides. This means that the potentially effective AgX grains for emulsion preparation contain at least 50% of $\gamma$-AgI. The proportion of $\gamma$-AgI as mentioned hereinabove is based on all the potentially effective AgX grains present and the actual content of $\gamma$-AgI may differ between individual grains or a $\gamma$-AgI containing phase may be present in part of the interior or grains.

In order to make potentially effective AgI grains having high $\gamma$-AgI content, a soluble silver salt may be reacted with a soluble halide salt by any suitable method such as a single-jet method, a double-jet method or a combination of these two methods. Also applicable is a method in which grains are formed in the presence of excess silver ions. One modification of the double-jet method is a controlled double-jet method in which a silver halide of interest is created with the pAg of the liquid phase medium being controlled at a constant value. This method is capable of producing a silver halide emulsion that is comprised of grains having a regular crystallographic shape and a substantially uniform size.

In order to obtain $\gamma$-AgI grains as the potentially effective AgX grains to be used in the present invention, pAg may generally be adjusted to lie within the range of 2.0–3.0 during AgI growth. The content of $\gamma$-AgI can be derived by the method described in Physical Review, Vol. 161, No. 3, page 848, 1967. According to this method, diffraction peaks are measured in the $2\Theta$ range of 20–30 degrees by powder X-ray diffraction and the intensities of the respective peaks are calculated to determine the content of $\gamma$-AgI.

As of today, it is not completely clear why increased sensitivity is attained when crystal growth is performed using as potentially effective AgI those AgI micrograins having $\gamma$-AgI in the crystal phase. Probably, $\gamma$-AgI dissolves faster than AgI in the other crystal phases, thereby increasing the chance of the creation of silver iodobromide and silver chloroiodobromide grains having high AgI content. Hence, it is generally observed that the increase in sensitivity which is one of the major advantages of the present invention can be accomplished more easily with core/shell grains having the core of higher AgI content in their interior.

The potentially effective AgX grains are preferably monodisperse and small in average grain size. As guide figures, the average size of those grains is preferably 0.7 μm and smaller, more preferably in the range of 0.3–0.005 μm, with the range of 0.1–0.01 μm being particularly preferred.

The growth of the grains of a seed emulsion with the aid of makeup AgX may be performed by a known process for preparing monodisperse emulsions, such as the one described in Unexamined Published Japanese Patent Application No. 48521/1979. In the practice of the present invention, makeup AgX may be supplied in more than one stage. Ammoniacal silver nitrate is preferably used to create makeup AgX. In this step of grain growth, the mother liquor is generally held at a temperature of 10°–70° C., preferably at 20°–60° C.; its pAg is generally held at 6–11, preferably at 7.5–10.5; its pH is generally held at 5–11, preferably at 6–10.

During the preparation of a AgX emulsion (including the preparation of a seed emulsion), non-gelatin substances that are capable of adsorbing AgX grains may be added. Useful examples of such adsorbents include those compounds which are commonly used as sensitizing dyes, antifoggants or stabilizers, as well as heavy metal ions. Specific examples of such adsorbents are described in Unexamined Published Japanese Patent Application No. 7040/1987. Among the adsorbents described above, at least one of the antifoggants and stabilizers is preferably added during the preparation of AgX emulsions for the purpose of reducing the fogging of the final emulsion and improving its time-dependent stability.

Among the antifoggants and stabilizers, heterocyclic mercaptocompounds and/or azaindene compounds are particularly preferred. Specific examples of more preferred heterocyclic mercapto compounds and azaindene compounds are described in detail in Japanese Patent Application No. 185917/1986 and they may be used with advantage. The amounts in which these heterocyclic mercapto compounds and azaindene compounds are used are not limited to any particular values but preferably they are used in amounts of $1\times10^{-5}$ to $3\times10^{-2}$, more preferably $5\times10^{-5}$ to $3\times10^{-3}$ moles, per mole of AgI. It should however be noted that suitable amounts are selected as appropriate depending on the condition of producing AgX grains, the average size of AgX grains and the type of the compounds mentioned above.

The finished emulsion which has been conditioned to satisfy the predetermined conditions for grains may be desalted by any known method after the formation of AgX grains. Desalting may be performed by one of the following three methods: using a gelatin coagulant or some other agent that is employed to desalt AgX grains as seed grains; noodle washing which involves the solidification of gelatin into a jelly; and flocculation which makes use of inorganic salts composed of polyvalent anions, as exemplified by sodium sulfate, anionic surfactants and anionic polymers (e.g. polystyrenesulfonic acid). The AgX grains desalted by one of those methods are usually redispersed in gelatin to prepare an intended AgX emulsion.

The composition of the AgX grains in the emulsion to be used in the present invention is not limited in any particular way and silver chloride, silver bromide, silver iodide and other silver halide compositions may be used at compositional ratios that comply with a specific object. The composition of AgX may be uniform throughout the grain or it may have a core/shell structure to form a double-layered grain. However, as already mentioned, a core/shell structure is particularly advantageous when the emulsion is prepared using potentially effective AgI.

A preferable core/shell structure is composed of a highly concentrated core containing more than 20 mol % of AgI and a shell containing less AgI. A more preferable structure has a core containing more than 20 mol % of AgI and an outermost shell containing less than 5 mol % of AgI being an average AgI concentration of the structure more than 6 mol %.

The average size of AgX grains also is not limited to any particular value and may be varied depending on the use but the preferred range is from 0.1 to 3.0 μm. The term "grain size" as used herein means the length of one side of a cubic AgX grain; if the shape of a AgX grain of interest is other than cube, one side of an equivalent cube having the same volume may be taken as the size of that grain. When the size of an individual grain as defined above is written as ri and if the sum of the grains measured is written as n, the average grain size is expressed by:

$$\text{Average grain size, } r = \frac{\Sigma ri}{n}.$$

Monodisperse AgX grains are such that the greater part of AgX grains as observed with an electron microscope are identical in shape and have a uniform grain size. Preferred monodisperse AgX grains are those which have a coefficient of variation (CV) of no more than 0.20, with CV being the standard deviation of the grain size distribution divided by the average grain size.

The emulsion to be used in the present invention may be chemically sensitized in the usual manner by various methods including sulfur sensitization which uses activated gelatin or compounds that contain sulfur capable of reaction with silver ion, selenium sensitization which uses selenium compounds, reduction sensitization which uses reducing materials, and noble metal sensitization which uses gold and other noble metal compounds. These methods of sensitization may be used either alone or in combination. Chalcogenide sensitizers may be used as chemical sensitizers in the present invention and sulfur sensitizers and selenium sensitizers are particularly preferred.

Exemplary sulfur sensitizers include thiosulfates, allylthiocarbazide, thiourea, allyl isothiocyanate, cystine, p-toluenethio-sulfonates and rhodanine. Other sulfur sensitizers that can be used are described in U.S. Pat. Nos. 1,574,944, 2,410,689, 2,278,947, 2,728,668, 3,501,313, 3,656,955, West German Patent Application (OLS) No. 1,422,869, and Unexamined Published Japanese Patent Application Nos. 24937/1981 and 45016/1980. The amount of addition of sulfur sensitizers may vary over a considerable range depending upon various conditions including pH. temperature and the size of silver halide grains. As guide figures, they are preferably used in amounts of from about $10^{-7}$ to $10^{-1}$ mole per mole of silver halide.

Exemplary selenium sensitizers include aliphatic isoselenocyanates such as allyl isoselenocyanate, selenoureas, selenoketones, selenoamides, selenocarboxylic acid salts and esters, selenophosphates, and selenides such as diethyl selenide and diethyl diselenide.

Specific examples of such selenium sensitizers are described in U.S. Pat. Nos. 1,574,944, 1,602,592 and 1,623,499.

In addition to sulfur and selenium sensitization, reduction sensitization may also be performed. Exemplary reducing agents include stannous chloride, thiourea dioxide, hydrazine and polyamines.

Noble metal compounds other than gold compounds may also be used and illustrative examples are palladium compounds.

The AgX grains in the emulsion to be used in the present invention preferably contain gold compounds. Gold compounds to be preferably used are such that the oxidation number of gold is +1 or +3 and many kinds of gold compounds within this class can be used. Typical examples include chloroauric acid salts, potassium chloroaurate, auric trichloride, potassium auric thiocyanate, potassium iodoaurate, tetracyanoauric azide, ammonium aurothiocyanate, pyridyl trichlorogold, gold sulfide and gold selenide.

The gold compounds may be used in such a way as to sensitize AgX grains or they may be used without making substantial contribution to sensitization. The amounts of addition of the gold compounds depend on various conditions. As guide figures, they are preferably used in amounts of $10^{-8}$ to $10^{-1}$ mole, more preferably from $10^{-7}$ to $10^{-2}$ mole, per mole of silver halide. Those gold compounds may be added at any time, such as during the formation of AgX grains, during physical ripening, during chemical ripening or after the end of chemical ripening.

The emulsion to be used in the present invention may be spectrally sensitized for a desired wavelength range using a suitable sensitizing dye. Sensitizing dyes may be used either independently or in combination. Together with sensitizing dyes, those dyes which themselves do not have spectral sensitizing action or those supersensitizers which are compounds substantially incapable of absorbing visible light and which enhance the sensitizing action of sensitizing dyes may also be contained in the emulsion.

The silver halide photographic material that is prepared by the procedure described above has high sensitivity and yet suffers from reduced fogging, whereby it is highly resistant to fogging by pressure.

The silver halide photographic material of the present invention finds use in many applications including black-and-white photography (as in X-ray photographic materials, lith-type photographic materials and black-and-white picture taking negative films) and color photography (as in color negative films, color reversal films and color papers). Said silver halide photographic material is also applicable as diffusion transfer light-sensitive materials (e.g. color diffusion transfer elements and silver halide diffusion transfer elements) and heat-processable photo-sensitive materials (in both black and chromatic colors).

For application to multi-color silver halide photographic materials which are processed by a subtractive color system for color reproduction, the silver halide photographic material of the present invention usually comprises a support on which emulsion layers containing a magenta, a yellow and a cyan coupler as photographic couplers and non-light-sensitive layers are superposed in appropriate numbers and in an appropriate order. The number of superposed layers and their order of arrangement may be changed as appropriate for the performance to be chiefly attained and the specific object of use.

If the silver halide photographic material of the present invention is a multi-color photographic material, a particularly preferred layer arrangement is such that a support is coated, in sequence, with a cyan image forming layer, an intermediate layer, a magenta image forming layer, an intermediate layer, a yellow image forming layer, an intermediate layer and a protective layer which is the topmost layer.

The photographic material of the present invention may contain various additives selected from among antifoggants, hardeners, plasticizers, latices, surfactants, color fog preventing agents, matting agents, lubricants and antistats.

The photographic material of the present invention may be subjected to various development processes for image formation. To take color development as an example, aminophenolic and p-phenylenediamine derivatives which are extensively used in various color photographic processes may be used as color developing agents in color developing solutions. In addition to primary aromatic amino color developing agents, compounds known to be contained as components of developing solutions may be added to color developing solutions which are to be employed in the processing of the photographic material of the present invention. This photographic material can also be processed by systems that are free from benzyl alcohol which is a potential cause of environmental pollutions.

Color developing solutions generally have a pH of at least 7, most typically in the range of from about 10 to about 13.

The temperature for color development is generally at least 15° C., most typically in the range of 20°–50° C. For rapid development, temperatures of at least 30° C. are preferably used. Ordinary processing takes 3–4 minutes but if emulsions are combined in such a way as to enable rapid processing, the time of color development can generally be shorted to the range of 20–60 seconds, and even shorter to the range of 30–50 seconds.

After color development, the photographic material can be subjected to bleaching and fixing. Bleaching may be performed simultaneously with fixing. Following fixing, the photographic material is usually washed with water. As an alternative to the washing step, stabilization may be performed. If desired, both washing and stabilizing may be performed.

The following example is provided for the purpose of further illustrating the present invention but is in no way to be taken as limiting. Before going in details of the example, let us describe the preparation of the silver iodide (AgI) micrograins used in that example, seed emulsions, the emulsions within the scope of the present invention and the comparative emulsions.

Preparation 1

Preparation of AgI micrograins:

Solutions A-1 to A-5 were prepared in the following manner.

| | |
|---|---|
| Solution A-1: | |
| Ossein gelatin | 224 g |
| Polyisopropylene-polyethyleneoxy-disuccinic acid ester sodium salt (10% ethanol sol.) | 13.44 cc |
| Sodium citrate | 16.8 g |
| Distilled water | to make 4480 cc |
| Solution A-2: | |

-continued

| | |
|---|---|
| $AgNO_3$ | 808.6 g |
| Distilled water | to make 1360 cc |
| Solution A-3: | |
| KI | 869.2 g |
| Distilled water | to make 1496 cc |
| Solution A-4: | |
| 3.5 N $AgNO_3$ (aq. sol.) | q.s. for pAg adjustment |
| Solution A-5: | |
| 3.5 N KI (aq. sol.) | q.s. for pAg adjustment |

Using the mixer-stirrer described in Unexamined Published Japanese Patent Application Nos. 92523/1982 and 92524/1982, solutions A-2 and A-3 were added to solution A-1 at 40° C. by a double-jet method at a speed of 45.33 cc per minute. During the addition by a double-jet method, pAg was held constant (for specific values, see Table 1) using solutions A-4 and A-5, whereby emulsions Em-1 to Em-6 containing AgI micrograins were produced with pAg during the addition being variable.

For each emulsion, the AgI micrograins were found to have an average size of ca. 0.04–0.08 μm by examination with an electron microscope.

The proportions of γ-AgI in the AgI micrograins in emulsions Em-1 to Em-6 are also shown in Table 1.

TABLE 1

| Emulsion No. | pAg | Proportion of γ-AgI (mol %) |
|---|---|---|
| Em-1 | 2.0 | 75 |
| Em-2 | 2.5 | 67 |
| Em-3 | 3.0 | 52 |
| Em-4 | 13.0 | 45 |
| Em-5 | 13.5 | 32 |
| Em-6 | 14.0 | 25 |

Preparation 2

Preparation of seed emulsions, the emulsions within the scope of the present invention and the comparative emulsions:

Preparation of Seed Emulsion N-1

To 500 ml of a 2.0% aqueous gelatin solution heated to 40° C., 250 ml of an aqueous solution of 4M (molar concentration) $AgNO_3$ and 250 ml of an aqueous solution of 4M KBr/KI (98:2 in molar ratio) were added by a controlled double-jet method over 35 min in accordance with the disclosure in Unexamined Published Japanese Patent Application No. 45437/1975, with pAg and pH being controlled at 9.0 and 2.0, respectively. An aqueous gelatin solution containing silver halide grains in an amount equivalent to all the silver content to be added was adjusted to 5.5 with an aqueous solution of potassium carbonate. Thereafter, 364 ml of a 5 wt % aqueous solution of a precipitant ("Demol" of Kao-Atlas Company, Ltd.) and 244 ml of 20 wt % magnesium sulfate as a polyvalent ion supply were added to cause flocculation. The mixture was then left to stand to have the gelatin floccules settle and the supernatant was removed by decantation. Following the addition of 1400 ml of distilled water, redispersal was effected. Further, 36.4 ml of a 20 wt % aqueous solution of magnesium sulfate was added to cause flocculation and, following settlement, the supernatant was removed by decantation. To the residue, an aqueous solution containing 28 g of ossein gelatin was added to make a total volume of 425 ml and the mixture was redispersed at 40° C. for 40 min, whereby a silver halide seed emulsion was prepared.

Examination with an electron microscope showed that this seed emulsion was a monodisperse emulsion comprising grains having an average size of 0.116 μm.

Preparation of Seed Emulsion N-2

By repeating the procedure for the preparation of seed emulsion N-1, a silver iodobromide seed emulsion N-2 was prepared; it had an average grain size of 0.33 μm and a silver iodide content of 2 mol %.

Preparation of Emulsion Em-11

To begin with, Em-1 or an emulsion containing silver iodide micrograins was prepared in accordance with the method described in Preparation 1.

Using the three aqueous solutions shown below, Em-1 and the seed emulsions, a silver halide emulsion Em-11 which was within the scope of the present invention was prepared.

| | |
|---|---|
| Aqueous solution B-1: | |
| Gelatin | 231.9 g |
| 10% Methanol solution of compound (I) identified below | 20.0 ml |
| 28% Aqueous ammonia | 1056 ml |
| Water | to make 11827 ml |
| Compound (I) | |

$$HO(CH_2CH_2O)m(\overset{\overset{CH_3}{|}}{C}HCH_2O)_{17}(CH_2CH_2O)nH$$

(av. mol. wt. ≃ 1300)

| | |
|---|---|
| Aqueous solution B-2: | |
| $AgNO_3$ | 1587 g |
| 20% Aqueous ammonia | 1295 ml |
| Water | to make 2669 ml |
| Aqueous solution B-3: | |
| KBr | 1572 g |
| Water | to make 3774 ml |

Emulsion solution B-4 containing AgI micrograins:

| | |
|---|---|
| Emulsion Em-1 containing AgI micrograins | 1499.3 g |
| 4-Hydroxy-6-methyl-1,3,3a,7-tetraazaindene | 5.2 g |
| Potassium hydroxide (10% aq. sol.) | 14.75 ml |
| Water | to make 1373 ml |

To vigorously stirred aqueous solution B-1 at 60° C., 0.407 moles of seed emulsions was added and, thereafter, pH and pAg were properly adjusted with acetic acid and an aqueous solution of KBr.

Subsequently, with pH and pAg being controlled as shown in Table 2, aqueous solutions B-2, B-3 and emulsion solution B-4 containing AgI micrograins were added by a triple-jet method at the flow rates respectively shown in Tables 3, 4 and 5.

TABLE 2

Grain growth conditions of Em-11

| Ag (%) | 0 | 29 | 29 | 56 | 100 |
|---|---|---|---|---|---|
| pH | 7.0 A | 7.0 C | 6.0 A | 6.0 A | 6.0 |
| pAg | 7.8 A | 7.8 C | 9.7 B | 10.1 A | 10.1 |

Notes:
A indicates constant pH or pAg;
B indicates gradual decrease; and
C indicates sudden decrease.

TABLE 3

| time (min) | Profile of the addition of B-2 rate of addition (ml/min) |
|---|---|
| 0 | 12.2 |
| 25.6 | 13.0 |
| 42.6 | 12.9 |
| 43.9 | 8.4 |
| 67.5 | 11.0 |
| 97.3 | 14.8 |
| 97.7 | 20.6 |
| 105.0 | 22.3 |
| 105.4 | 25.4 |
| 112.3 | 32.1 |
| 112.6 | 35.1 |
| 129.4 | 90.3 |
| 145.7 | 194.2 |
| 145.7 | 200.5 |
| 147.4 | 203.9 |

TABLE 4

| time (min) | Profile of the addition of B-2 rate of addition (ml/min) |
|---|---|
| 0 | 10.9 |
| 25.6 | 11.7 |
| 42.6 | 11.6 |
| 43.9 | 7.6 |
| 97.3 | 13.3 |
| 97.7 | 18.6 |
| 105.0 | 20.0 |
| 105.0 | 36.5 |
| 112.0 | 56.2 |
| 112.3 | 60.6 |
| 121.2 | 106.0 |
| 121.4 | 91.4 |
| 132.7 | 263.3 |
| 132.7 | 141.8 |
| 147.4 | 230.9 |

TABLE 5

| time (min) | Profile of the addition of B-2 rate of addition (ml/min) |
|---|---|
| 0 | 0 |
| 43.9 | 0 |
| 43.9 | 73.6 |
| 51.7 | 80.6 |
| 52.5 | 28.5 |
| 84.3 | 40.4 |
| 84.9 | 11.6 |
| 97.7 | 13.0 |
| 105.0 | 14.1 |
| 105.4 | 16.3 |
| 112.3 | 20.6 |
| 112.6 | 6.2 |
| 130.4 | 17.5 |
| 132.7 | 22.1 |
| 145.7 | 34.4 |

After the end of addition, an aqueous solution of phenylcarbamylated gelatin was added and the grains were permitted to settle and agglomerate by adjusting the pH of the mixed solution, followed by desalting and washing with water. Thereafter, pH and pAg were adjusted to 5.80 and 8.06, respectively, at 40° C. As a result, a monodisperse AgIBr emulsion was obtained that had an average grain size of 0.99 μm, an average AgI content of 8.0 mol % and a grain size distribution of 11.2%. This emulsion is designated Em-11.

Subsequently, emulsions Em-12 to Em-16 were prepared in entirely the same manner as Em-11 except that the emulsion containing AgI micrograins was changed to Em-2 to Em-6, respectively.

The example of the present invention is specifically described below.

EXAMPLE 1

Each of the emulsions Em-11 to Em-16 described in Preparation 2 was subjected to gold-plus-sulfur sensitization. Each of those emulsions was then sensitized spectrally to have sensitivity to green light by addition of sensitizing dyes (1) and (2) (see below) in respective amounts of 225 mg and 170 mg per mole of silver. Subsequently, the emulsions were stabilized by addition of tetraazaindene (TAI) and 1-phenyl-5-mercaptotetrazole.

Further, magenta coupler M-1 (see below) was dissolved in ethyl acetate and dinonyl phthalate (DNP) and the solution was dispersed in a gelatin containing aqueous solution. The resulting dispersion and common photographic additives such as a spreading agent and a hardener were added to each of the stabilized emulsions to prepare coating solutions, which were applied to subbed film bases and dried in the usual manner, whereby sample Nos. 101–106 were prepared.

The deposits of the respective components are shown below on the basis of one square meter.

| | |
|---|---|
| Emulsion | 1 g (as silver) |
| Magenta coupler M-1 | 0.4 g |
| DNP | 0.4 g |
| Gelatin | 0.12 g |

Sensitizing dye (1)

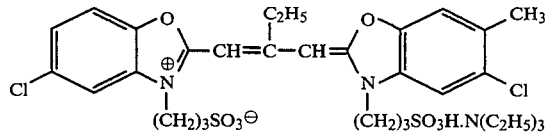

Sensitizing dye (2)

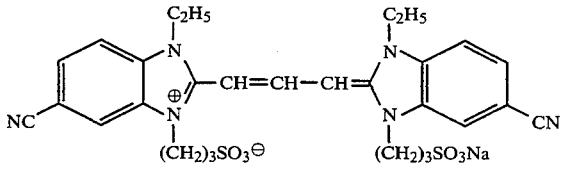

Magenta coupler M-1

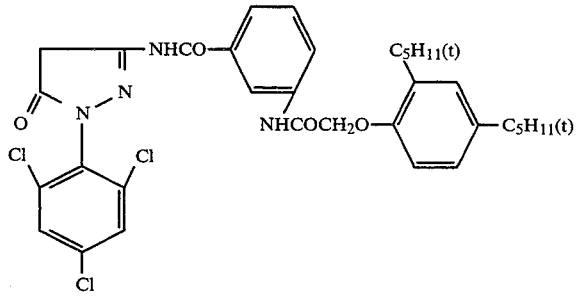

For checking sensitivity, each of the samples was subjected to wedge exposure and subsequently processed by the following scheme.

| Processing scheme (38° C.) | |
|---|---|
| Color development | 3 min and 15 sec |
| Bleaching | 6 min and 30 sec |
| Washing with water | 3 min and 15 sec |
| Fixing | 6 min and 30 sec |
| Washing with water | 3 min and 15 sec |
| Stabilizing | 1 min and 30 sec |
| Drying | |

The solutions used in the steps of color development, bleaching, fixing and stabilizing had the following recipes.

| | |
|---|---|
| Color developing solution | |
| 4-Amino-3-methyl-N-ethyl-N-(β-hydroxy-ethyl)aniline sulfate salt | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Water | to make 1000 ml |
| pH | adjusted to 10.0 |
| Bleaching solution | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| Water | to make 1000 ml |
| pH | adjusted to 6.0 with aqueous ammonia |
| Fixing solution | |
| Ammonium thiosulfate | 175.0 g |
| Anhydrous sodium sulfite | 8.5 g |
| Sodium metasulfite | 2.3 g |
| Water | to make 1000 ml |
| pH | adjusted to 6.0 with acetic acid |
| Stabilizing solution | |
| Formaldehyde (37% aq. sol.) | 1.5 ml |
| Konidax (Konica Corp.) | 7.5 ml |
| Water | to make 1000 ml |

The processed samples were measured for sensitivity and fog. The results are shown in Table 6.

TABLE 6

| Sample No. | Sensitivity* | Fog | Remarks |
|---|---|---|---|
| 101 | 100 | 0.04 | invention |
| 102 | 95 | 0.04 | invention |
| 103 | 95 | 0.04 | invention |
| 104 | 70 | 0.05 | comparison |
| 105 | 50 | 0.06 | comparison |
| 106 | 55 | 0.06 | comparison |

*Sensitivity: Defined as the reciprocal of the amount of exposure that provides a fog density + 0.1. Expressed in relative values, with the sensitivity of sample No. 101 being taken as 100. The higher the value, the higher the sensitivity.

As will be understood from Table 6, sample Nos. 101–103 which used emulsions that were prepared by performing crystal growth using AgI micrograins containing at least 50% γ-AgI possessed the intended advantages of the present invention in that they had high sensitivity while suffering from low fogging.

As described on the foregoing pages, the silver halide photographic material of the present invention retains the advantages offered by the crystal nucleation process which uses fine silver iodide grains and yet said material has higher sensitivity while suffering from lower fogging.

What is claimed is:

1. A method for preparing a silver halide emulsion comprising silver halide grains which are mixed crystals comprising: preparing a seed emulsion comprising seed grains; and adding potentially effective silver iodide grains comprising a silver halide micro grains, at least 50 mol % having a γ-AgI structure, a soluble silver salt and a soluble halide to the seed emulsion.

2. A method for preparing a silver halide emulsion of claim 1, the silver halide emulsion is mono-dispersed emulsion which has a coefficient of variation of no more than 0.20.

3. A method for preparing a silver halide emulsion of claim 1, the silver halide grains has a core/shell structure and the core of said silver halide grain is 20 mole % or more of silver iodide content.

4. A method for preparing a silver halide emulsion of claim 1, adding the potentially effective silver iodide grains comprising a silver halide micro grains having γ-AgI structure until the end of the supply of elements for forming the silver halide grains.

5. A method for preparing a silver halide emulsion of claim 1, hereto-cyclic mercapto compounds and/or azaindene compounds are added during the preparation of the silver halide emulsion.

6. A method for preparing a silver halide emulsion of claim 1, the average size of silver halide grains is from 0.1 to 3.0 μm.

7. A method for preparing a silver halide emulsion of claim 1, gold compounds are contained in the silver halide grains.

8. The method of claim 1 wherein said seed grains comprise silver bromide and silver iodide.

* * * * *